US007552567B2

(12) United States Patent
Ingratta et al.

(10) Patent No.: US 7,552,567 B2
(45) Date of Patent: Jun. 30, 2009

(54) SEISMIC PERIMETER CLIP FOR SUSPENDED CEILING GRID

(75) Inventors: Anthony D. Ingratta, Dyer, IN (US); Peter G. Jahn, Palos Park, IL (US); Scott Jankovec, Elmhurst, IL (US); Richard W. Harney, Berwyn, IL (US)

(73) Assignee: Chicago Metallic Corporation, Chicago, IL (US)

( * ) Notice: Subject to any disclaimer, the term of this patent is extended or adjusted under 35 U.S.C. 154(b) by 594 days.

(21) Appl. No.: 11/220,886

(22) Filed: Sep. 7, 2005

(65) Prior Publication Data

US 2006/0096219 A1 May 11, 2006

Related U.S. Application Data

(60) Provisional application No. 60/607,543, filed on Sep. 7, 2004.

(51) Int. Cl.
*E04B 9/34* (2006.01)
*E04C 2/42* (2006.01)

(52) U.S. Cl. ..... 52/506.07; 52/665; 52/506.06; 52/506.08; 52/506.05

(58) Field of Classification Search ..... 52/506.01, 52/506.02, 506.03, 506.04, 506.05, 506.06, 52/506.07, 506.08, 506.09, 506.1, 733.1, 52/167.1, 712, 698, 665, 220.6, 289, 489.1, 52/664, 483.1, 489.2, 167.3; 403/63, 66, 403/70, 230, 116

See application file for complete search history.

(56) References Cited

U.S. PATENT DOCUMENTS 3,089,570 A * 5/1963 O'Neil ..... 52/713
3,677,589 A * 7/1972 Roles ..... 403/217
3,798,865 A * 3/1974 Curtis ..... 52/665
4,089,146 A 5/1978 Martinez
4,479,341 A * 10/1984 Schuplin ..... 52/665

(Continued)

OTHER PUBLICATIONS

Bailey Metal Products Limited—Suspended Ceiling Systems Product Catalog dated Dec. 1995.

(Continued)

*Primary Examiner*—Richard E Chilcot, Jr.
*Assistant Examiner*—Alp Akbasli
(74) *Attorney, Agent, or Firm*—Cook Alex Ltd.

(57) ABSTRACT

A perimeter clip is made of a single piece of sheet metal and includes first and second legs that are bent at approximately 90 degrees with respect to each other. The first leg is for engaging the vertical leg of a wall angle. The second leg is adapted to receive the head or bulb of the runner. The first leg includes an upper portion and a lower portion. The upper portion of the first leg forms a back plate that is displaced from the plane of the lower portion, with a generally horizontal ledge connecting the upper portion to the lower portion. The first leg has a tongue or tab that is displaced from the plane of the remainder of the lower portion so that, when in place, the vertical leg of the wall angle is held between the tongue and the remainder of the lower portion. The upper portion of the second leg comprises an inverted, generally U-shaped member, the open end of which forms a trough that supports the lower surface of the bulb of the runner.

7 Claims, 2 Drawing Sheets

U.S. PATENT DOCUMENTS

| | | | | | |
|---|---|---|---|---|---|
| 4,525,973 | A | | 7/1985 | Vukmanic et al. | |
| 4,580,386 | A | | 4/1986 | Hemphill et al. | |
| 4,583,340 | A | * | 4/1986 | Sauer | 52/506.07 |
| 4,610,562 | A | | 9/1986 | Dunn | |
| 4,715,161 | A | | 12/1987 | Carraro et al. | |
| 4,850,172 | A | | 7/1989 | Gailey et al. | |
| 5,046,294 | A | * | 9/1991 | Platt | 52/506.06 |
| 5,195,289 | A | * | 3/1993 | LaLonde et al. | 52/506.06 |
| 5,253,463 | A | | 10/1993 | Witmyer | |
| 5,271,202 | A | | 12/1993 | Vukmanic et al. | |
| 5,572,844 | A | * | 11/1996 | Stackenwalt et al. | 52/506.07 |
| 5,619,833 | A | | 4/1997 | Neff | |
| 5,687,525 | A | * | 11/1997 | Koski et al. | 52/506.07 |
| 5,937,605 | A | * | 8/1999 | Wendt | 52/506.06 |
| 5,941,029 | A | | 8/1999 | MacLeod | |
| 5,966,887 | A | | 10/1999 | Mieyal | |
| 5,979,134 | A | | 11/1999 | Neff | |
| 6,119,784 | A | | 9/2000 | MacDonald, III et al. | |
| 6,123,154 | A | | 9/2000 | MacDonald, III et al. | |
| 6,178,712 | B1 | | 1/2001 | Sauer | |
| 6,199,343 | B1 | | 3/2001 | Sauer et al. | |
| 6,488,097 | B1 | | 12/2002 | MacDonald, III et al. | |
| 7,293,393 | B2 | * | 11/2007 | Kelly et al. | 52/665 |
| 2004/0068953 | A1 | | 4/2004 | Sauer | |
| 2005/0160696 | A1 | | 7/2005 | Kelley et al. | |
| 2007/0180787 | A1 | | 8/2007 | Fecska | |

OTHER PUBLICATIONS

Armstrong Building Products—Seismic Installations Brochure—"What You Need to Know" dated 2003.

* cited by examiner 10
12
14
16
18
20
22
24
26
28
30
32
34
36
38
40
44
48
48a
49
50
52
54a
54b
54c 10
26
28
30
32
34
36
38
40
42
44
46
48
48a
49
50
52
54a
54b
54c
56

SEISMIC PERIMETER CLIP FOR SUSPENDED CEILING GRID

CROSS REFERENCE TO RELATED APPLICATION

This application claims the benefit of U.S. Provisional Application Ser. No. 60/607,543, filed Sep. 7, 2004.

BACKGROUND OF THE INVENTION

The present application is directed to a perimeter clip for attaching a main or cross runner of a suspended ceiling grid to a wall angle. The clip permits the end of the runner to move away from the wall angle by up to two inches to maintain the grid system intact during a seismic event.

Building codes are being revised to address concerns raised by seismic events. With respect to suspended ceiling performance, concerns include providing adequate support to the individual ceiling panels around the perimeter of the ceiling to prevent the perimeter panels from falling from the ceiling plane. The Federal Emergency Management Agency (FEMA) has determined that good seismic performance is more likely to be obtained by using wider wall molding or wall angle on all sides. This has lead to a revision of the International Building Code to require a two-inch wall molding. In areas subject to light to moderate seismic activity ("Seismic Design Category C") the grid is not to be attached to the wall molding, and at least ⅜ inch movement of the grid into or toward the wall during a seismic event must be accommodated. In areas subject to severe seismic activity ("Seismic Design Categories D, E and F") the grid is to be attached to two adjacent walls, and at least ¾ inch movement of the grid into or toward the wall during a seismic event must be accommodated by the opposite walls.

Accordingly, it is an object of the present invention to provide a perimeter clip adapted to secure a suspended ceiling grid to a perimeter wall in accordance with the requirements of the International Building Code.

A related object is to provide a single perimeter clip that may be used in accordance with the International Building Code for various Seismic Design Categories.

SUMMARY OF THE INVENTION

These objects, as well as others that will become apparent upon reference to the following detailed description and accompanying drawings, are achieved by a perimeter clip that is made of a single piece of sheet metal and includes first and second legs that are bent at approximately 90 degrees with respect to each other. The first leg is for engaging the vertical leg of a wall angle. The second leg is adapted to receive the head or bulb of the runner.

In one aspect of the invention, the first leg includes an upper portion and a lower portion. The upper portion of the first leg forms a back plate that is displaced from the plane of the lower portion, with a generally horizontal ledge connecting the upper portion to the lower portion, so that the back plate lies flush against the wall above the vertical leg of the wall angle. The upper portion is preferably over-sized and may include one or more holes for receiving fasteners to secure the perimeter clip to the wall.

In another aspect of the invention, the first leg has a tongue or tab that is displaced from the plane of the remainder of the lower portion so that, when in place, the vertical leg of the wall angle is held between the tongue and the remainder of the lower portion. The lower portion preferably includes stiffening embossments that extend out of the plane of the lower portion in the same direction as the tongue, so that when the lower portion is placed over the vertical leg of the wall angle, the vertical leg is firmly held between the embossments and the tongue. The embossments may also have apertures therein, through which screws or other fasteners may be inserted to further secure the perimeter clip to the wall angle and the wall.

In another aspect of the invention, the upper portion of the second leg comprises an inverted, generally U-shaped member, the open end of which forms a trough that supports the lower surface of the bulb of the runner. The trough includes an opening sized to receive the web of the associated runner. The top of the U-shaped section has a central cut-out, into which protrudes a downwardly-extending resilient or spring tongue. The tongue engages the top of the bulb of the runner, and permits the perimeter clip to be used with runners with varying sized bulbs. Specifically, the depth of the U-shaped section is sized to accommodate the largest standard sized bulb. The tongue presses against the bulb of the runners so that runners with shorter bulbs have their lower surface forced into engagement with the trough.

In another aspect of the invention, the second leg includes cutouts spaced at ⅜ inch and ¾ inch from the first leg to permit the installer to view the runner to insure that the runner is spaced properly with respect to the wall angle to meet building code requirements.

In a further aspect of the invention, the second leg may also include a lower portion that lies along the web of the runner. The lower portion has a series of holes (three shown) that are adapted to receive screws, pop rivets or other fasteners to secure the perimeter clip to the runner, when appropriate.

BRIEF DESCRIPTIONS OF THE DRAWINGS

DETAILED DESCRIPTION OF THE PREFERRED EMBODIMENT

Figure 1:
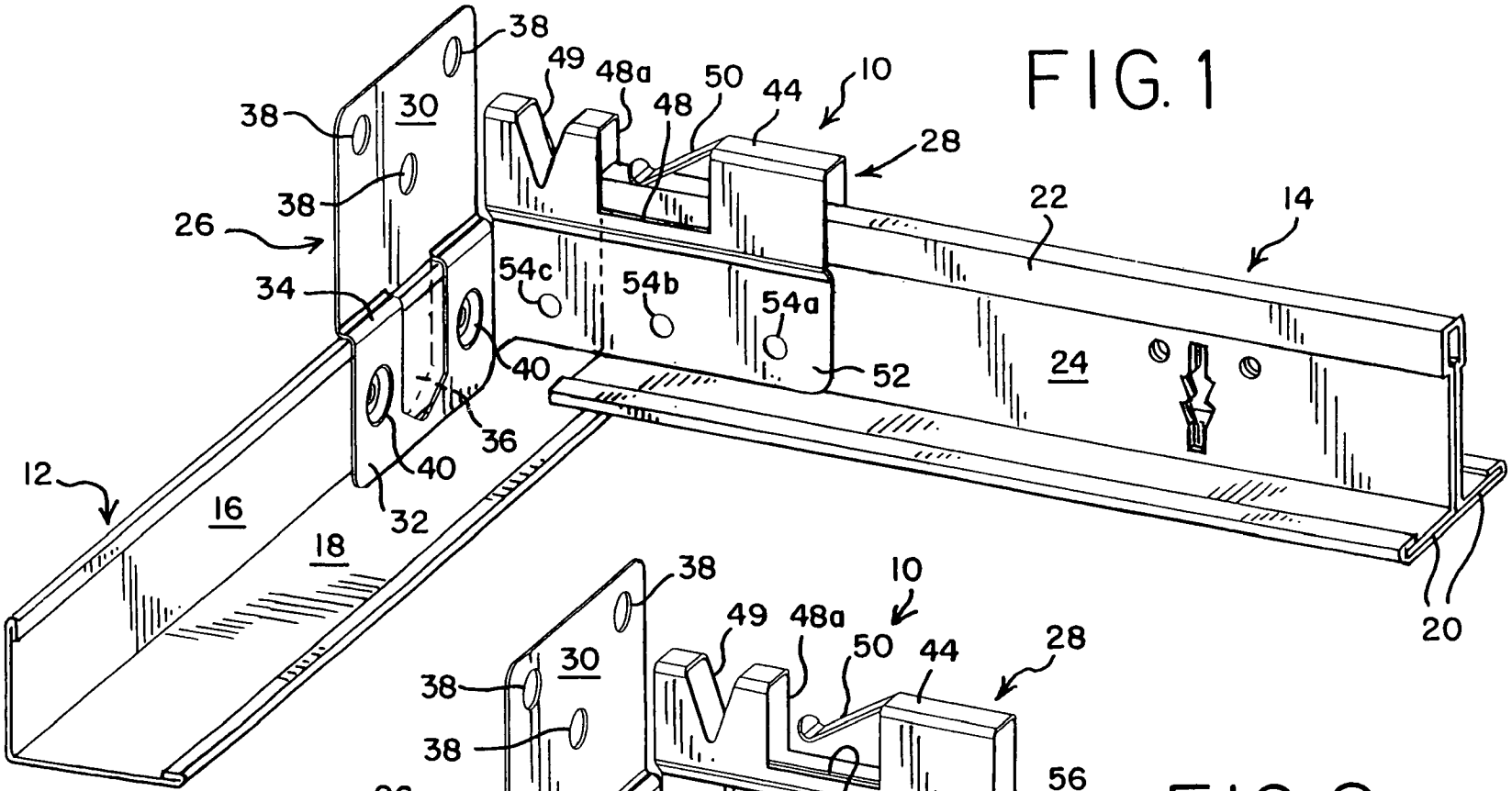
FIG. 1 is a perspective view of a seismic perimeter clip according to the present invention in combination with a wall angle and a runner.

Turning to the figures of the drawings, there is seen in FIG. 1 an exemplary embodiment of a seismic perimeter clip according to the present invention, generally designated 10, in combination with a standard wall angle 12 and runner or tee 14. As is well known, a plurality of such tees and wall angles are assembled together to form a grid to support ceiling panels or tiles in a suspended ceiling. The wall angle 12 is generally L-shaped and includes a vertical flange or leg 16, through which the wall angle 12 is secured to the wall by, e.g., fasteners, and a horizontal flange or leg 18 adapted to support an edge of an associated ceiling tile or panel (not shown). The runner or tee 14 has an inverted T-shape that comprises a pair of opposed horizontal flanges 20 adapted to support the edges of associated ceiling tiles, a strengthening bulb 22, and a web 24 intermediate strengthening bulb 22 and the flanges 20. The structure and manufacture of the wall angle 12 and the runner 14 are well known in the art.

In accordance with the present invention, a clip 10 is provided for attaching the runner to the wall angle while permitting a pre-determined amount of relative movement between the runner and the wall angle. Thus, in the event of a seismic occurrence, relative movement between the wall angle and the ceiling grid is permitted while keeping the grid secured to the wall angle. To this end, the clip 10 has a first leg 26 adapted to mount the clip 10 to the wall angle 12 and a second leg 28 extending generally perpendicularly from the first leg 26 adapted to slidably support the tee 14 primarily by capturing the strengthening bulb 22 of the tee.

In one aspect of the invention, the first leg 26 has a substantially planar upper portion or back plate 30 and a substantially planar lower portion 32 depending therefrom. The upper portion 30 lies in a plane displaced from the plane of the lower portion 32, with a ledge 34 connecting the upper portion 30 to the lower portion 32. A tongue 36 depends downwardly from the upper portion 30 and in the same plane therewith so that the vertical leg 16 of the wall angle 12 may be received between the tongue 36 and the lower portion 32 of the first leg 26 of the clip 10, with the tongue 36 being sandwiched between the vertical leg 16 of the wall angle 12 and the wall. The ledge 34 helps to seat the clip 10 on the wall angle 12 and also helps to prevent the clip 10 from rotating with respect to the wall angle 16.

The upper portion or back plate 30 of the first leg 26 of the clip 10 is sized to have a sufficiently large surface area to help maintain the second leg 28 of the clip 10 that supports the tee 14 perpendicular to the wall to which the wall angle 12 is secured. In practice, the back plate 30 is approximately 2" wide by 1⅜" tall to have a surface area of between approximately 2½ to 2¾ square inches. Preferably, the clip 10 is positively secured to the wall. To this end, the upper portion 30 of the first leg 26 includes one or more holes or apertures 38 (three shown) adapted to receive screws, fence staples, or other fasteners to positively attach the clip 10 to the wall. The holes 38 are positioned on the back plate 30 to permit the fasteners, in particular fence staples, to be installed at various angles.

In order to more securely hold the vertical leg 16 of the wall angle 12 between the lower portion 32 of the first leg 26 and the tongue 36 depending downwardly from the upper portion 30, the lower portion 32 is formed with embossments 40 that protrude from the lower portion 32 in the direction of the tongue 36. The embossments 40 may optionally be formed with apertures or starter holes 42 adapted to receive a fastener, such as a screw, to positively secure the clip 10 and the wall angle 12 to the wall.

In another aspect of the invention, the second leg 28 of the clip includes a downwardly-opening segment, generally designated 44, for capturing the bulb 22 of the tee 14. The downwardly-opening segment 44 has an opening 46 with a width sized to receive the web 24 of the tee 14, but too narrow to permit the bulb 22 to pass through without deformation of the segment 44. As such, a tee 14 can be received in the segment 44 of the second leg 28 of the clip 10 by either longitudinally sliding the tee into the segment 44 or by snap-fitting the segment 44 over the bulb 22 of the tee 14. As seen in FIGS. 1, 2, 4 and 6, the top of the segment 44 has a squared-off, box-like inverted U-shaped cross section. If greater resilience is required to facilitate deflection of the segment 44 to snap-fit the clip 10 onto a tee 14, the top of the segment 44 can be formed with an arcuate cross-section as shown in FIG. 7.

Figure 2:
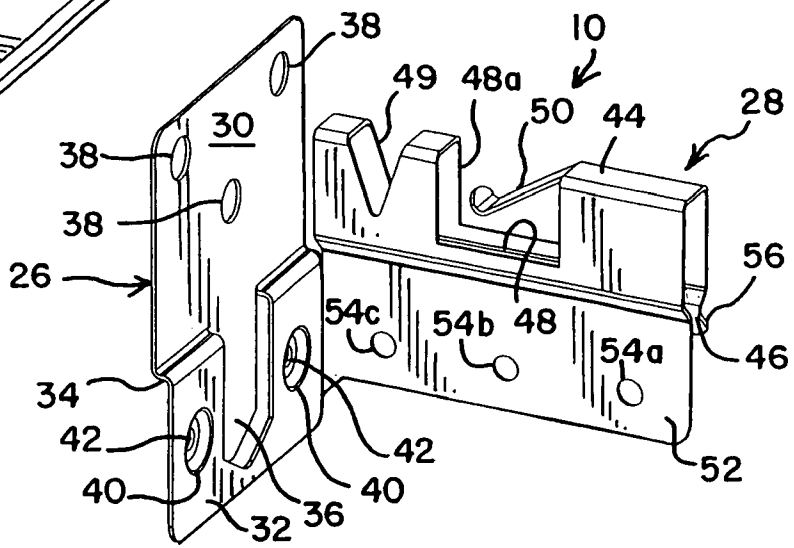
FIG. 2 is a perspective view of the seismic perimeter clip shown in FIG. 1.
Figure 3:
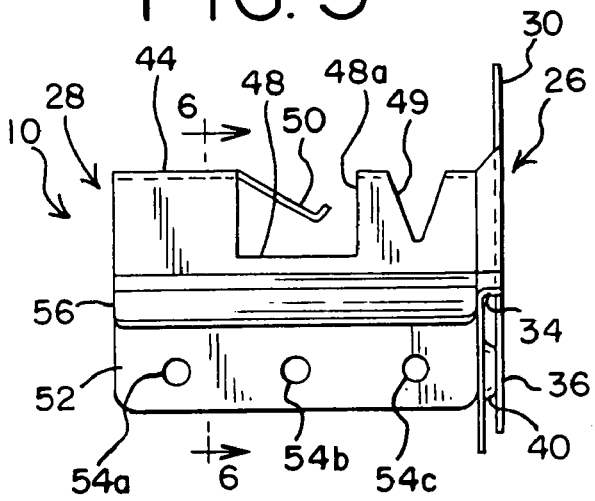
FIG. 3 is a plan view of the seismic perimeter clip of FIG. 2.
Figure 8:
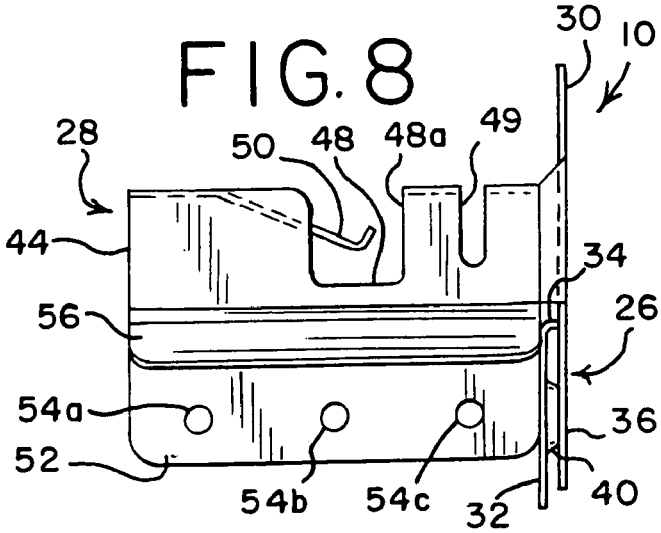
FIG. 8 is a plan view similar to FIG. 3 of a further alternate embodiment of a seismic perimeter clip according to the present invention.

Preferably, the segment 44 includes an open middle portion or window 48 through which the bulb 22 of the tee 14 can be seen when the clip is installed on a tee 14. In practice, the edge 48*a* of the window 48 is spaced approximately ¾ inch from the juncture of the first leg 26 with the second leg 28. This permits visual confirmation that the tee 14, when installed in an assembled ceiling grid, is spaced at least ¾ inch from the wall angle 12, as required by the International. Building Code seismic design categories D, E and F. In addition, the segment 44 includes a cut-out 49 between the window 48 and the first leg 26 to permit visual confirmation that the runner is spaced at least ⅜ inch from the perimeter, as required by the International Building Code for seismic design category C. As seen in FIGS. 1-3, the cut out 49 is V-shaped, with the apex of the cut-out being ⅜ inch from the first leg 26. Alternate shapes for the cut-out 49 are also contemplated. As shown in FIG. 8, the cut-out 49 is more in the configuration of a slot, the mid-point which is ⅜ inch from the first leg 26.

In addition, the segment 44 includes a resilient tongue 52 that extends downwardly from the top of the segment 44 into the window 48. The tongue 50 contacts the top of the bulb 22 to force the bottom of the bulb 22 toward the opening 46 in the segment 44, thus insuring that the bulb seats in the trough formed by the segment 44. This permits the clip 10 to accommodate tees having various bulb heights, and also assists in setting the height of the clip 10 above the horizontal leg 18 of the wall angle 12. The resilient tongue 50 may be lengthened (as shown in FIG. 8) to increase its resilience.

In keeping with another aspect of the invention, means are provided for facilitating attachment of the second leg 28 of the clip 10 to the runner 14. To this end, the downwardly-opening segment 14 that captures the bulb 22 of the runner 14 includes a generally planar lower flange-like portion 52 depending in a generally vertical relation from one side of the opening 46 so as to lie along the web 24 of the runner 14. The lower flange portion 52 includes at least one aperture adapted to receive a screw or other fastener (not shown) to provide positive securement of the clip 10 to the runner 14. As illustrated, three such apertures 54*a-c* are shown spaced along the length of the flange 52. Aperture 54*c* may be advantageously located ⅜ inch from the first leg 26, thus, providing an additional means for visual confirmation that the runner 14, when captured by the clip 10 and in the installed grid, is at least ⅜ inch from the wall angle 12, in compliance with the International Building Code.

Figure 4:
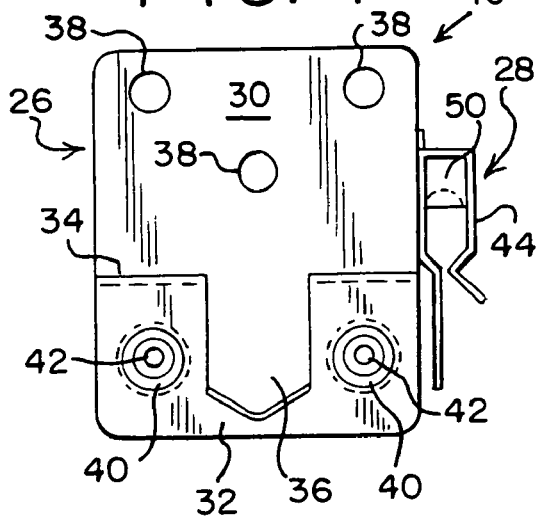
FIG. 4 is a right-end view of the seismic perimeter clip of FIG. 3.
Figure 5:
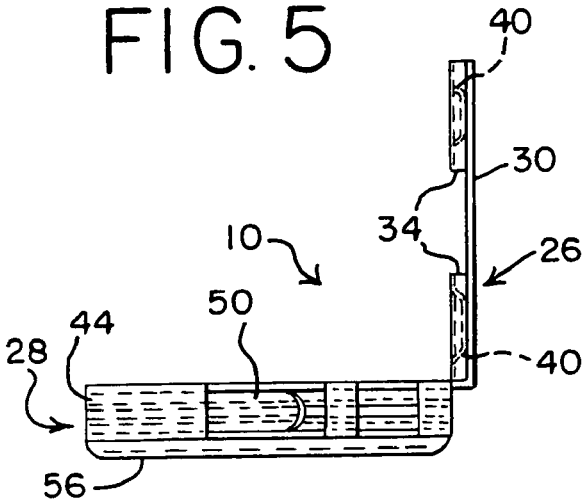
FIG. 5 is a top view of the seismic perimeter clip of FIG. 3.
Figure 6:
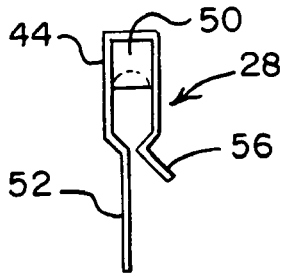
FIG. 6 is a sectional view of the seismic perimeter clip taken along line 6-6 of FIG. 3.
Figure 7:
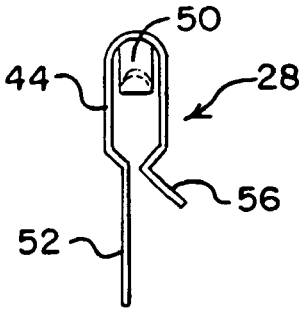
FIG. 7 is a sectional view similar to FIG. 6 of an alternate embodiment of a seismic perimeter clip according to the present invention.

The downwardly-opening segment 44 of the second leg 28 of the clip 10 also preferably includes a return leg or segment 56 depending from the downwardly-opening segment 44 at an oblique angle (as best seen in FIGS. 4, 6 and 7). The return leg 56 facilitates locating or guiding the bulb 22 of the runner 14 into the downwardly-opening segment 44 when snap-fitting the clip 10 onto the runner 14. The return leg 56 also serves as a deflection surface that, when engaged by the bulb 22 of the runner 14, helps to enlarge the opening 46 sufficiently to permit the bulb 22 to pass through.

Accordingly, a seismic perimeter clip has been provided that meets the objects of the present invention. While a detailed description of certain preferred embodiments of the invention have been provided, it is to be understood that these embodiments are merely exemplary of the invention, which may be embodied in various forms and combinations. Therefore, the specific details disclosed are not to be interpreted as limiting, but merely as a basis for the claims and as a representative basis for teaching one skilled in the art to variously employ the present invention in the appropriate manner.

What is claimed:

1. A clip for attaching a runner for a suspended ceiling grid to a wall angle, the runner having an inverted T-shape with a strengthening bulb at the upper end thereof extending from a web and the wall angle having an L-shape with a vertically-extending leg, the clip comprising:

a first leg adapted to be mounted to the vertically extending leg of the wall angle comprising a substantially planar upper portion and a substantially planar lower portion, the upper portion being displaced from the lower portion, a generally horizontal ledge joining the upper portion to the lower portion, and a tongue depending from the upper portion so that the vertical leg of the wall angle may be received between the tongue and the lower portion of the first leg; and a second leg adapted to receive the bulb of the runner comprising a downwardly opening segment for receiving the bulb of the runner, the opening having a width sized to receive the web and defining a trough to prevent the bulb from passing therethrough in the absence of deformation of the segment, the segment having an open middle portion and a resilient tongue extending into the open middle portion for engaging the bulb of the runner to force it into contact with the trough.

2. The clip of claim 1 wherein the lower portion of the first leg further comprises at least one embossment projecting therefrom toward a plane defined by the tongue.

3. The clip of claim 1 wherein the embossment includes an aperture adapted to receive a fastener.

4. The clip of claim 1 wherein the upper portion of the first leg comprises at least one aperture, adapted to receive a fastener.

5. The clip of claim 1 in which the downwardly-opening segment of the second leg further comprises a lower portion extending generally vertically from the trough along one side of the opening, the lower portion being adapted to lie along the web of the runner and having at least one aperture therein adapted to receive a fastener for positive securment of the clip to the runner.

6. The clip of claim 1 in which the downwardly-opening segment of the second leg further comprises a lower portion extending from the trough along one side of the opening, the lower portion forming an oblique angle with respect to the web of the runner.

7. The clip of claim 1 wherein the downwardly-opening segment of the second leg comprises a top that has an arcuate cross-section.

* * * * *